US007222833B2

(12) United States Patent
Yang

(10) Patent No.: US 7,222,833 B2
(45) Date of Patent: May 29, 2007

(54) PICTURE FRAME HANGER

(75) Inventor: David Yang, Moraga, CA (US)

(73) Assignee: Yang Ue-Ming, Moraga, CA (US)

( * ) Notice: Subject to any disclaimer, the term of this patent is extended or adjusted under 35 U.S.C. 154(b) by 60 days.

(21) Appl. No.: 11/181,963

(22) Filed: Jul. 15, 2005

(65) Prior Publication Data

US 2007/0012850 A1 Jan. 18, 2007

(51) Int. Cl.
*A47G 1/16* (2006.01)

(52) U.S. Cl. ..... 248/493; 248/547

(58) Field of Classification Search ..... 248/493, 248/475.1, 547, 489, 497, 328
See application file for complete search history.

(56) References Cited

U.S. PATENT DOCUMENTS 3,226,065 A * 12/1965 Smith ..... 248/493
3,294,356 A * 12/1966 Sherman ..... 248/476
5,878,988 A * 3/1999 Rakower ..... 248/497
6,651,945 B2 * 11/2003 Rivellino et al. ..... 248/206.5
6,672,551 B2 * 1/2004 Rivellino et al. ..... 248/206.5
2004/0051022 A1 * 3/2004 Weck et al. ..... 248/475.1

* cited by examiner

*Primary Examiner*—Ramon O Ramirez

(57) ABSTRACT

The hanger of present invention comprises of an integral hook and anchor sections in the upper and lower parts of hanger respectively. The hook section forms an U-hook for suspending and retaining the hanging wire of a picture frame. The anchor section guides a fastener such as a nail to drive through the anchor section and into the wall in inclined position. The hanger of present invention allows the hanging wire of the picture frame to directly engage into the U-hook without interference when a person holds the picture frame against the wall, and slides the picture frame downward to approach the hanger from the top of hanger.

19 Claims, 5 Drawing Sheets

PICTURE FRAME HANGER

BACKGROUND OF THE INVENTION

This invention relates to wall-mounted hangers for hanging a picture frame that is provided with a hanging wire at the back of picture frame.

More specifically, this invention relates to picture frame hangers that can be fabricated from continuously bending of a metal strip, and can be attached to walls, such as dry walls by driving a nail through the hanger and into the wall in inclined position.

Many picture frames have a hanging wire attached to the back of the picture frame. A variety of wall-mounted hangers in prior art have been proposed for suspending the hanging wire of the picture frame onto the wall. The hangers in prior art mainly consist of an anchor section in the upper part of the hanger, and a hook section in the lower part of the hanger. The anchor section allows a fastener such as a nail to drive through the hanger, and mount the hanger onto the wall. The hook section forms an U-hook for suspending and retaining the hanging wire of the picture frame. In prior art, a lateral projectile is commonly provided in the anchor section, which guides the nail driving through the hanger and entering into the wall in inclined position. The inclined position of the nail offers the advantages of enhancing the loading capacity of the hanger, preventing the hanger from swiveling or pivoting about the nail, and preventing the nail from sliding out of the wall. The anchor section of the hanger is located directly above the hook section of the hanger. The hangers are commonly fabricated from continuously bending of a metal strip. The above described hangers in prior art can be found in U.S. Pat. Nos. 1,675,281, 3,226,065, 2,137,837, 2,454,813, 2,940,712, and 5,267,719, . . . etc. FIG. 1 illustrates the hanger in prior art that is disclosed in U.S. Pat. No. 1,675,281.

There is a significant drawback of the above hangers in prior art because the anchor section of the hanger is located directly above the hook section of the hanger. When hanging a picture frame onto the hanger, a person can hardly see the hanger behind the picture frame when he or she is holding the picture frame against the wall and the hanger. Therefore, it is a common practice for a person to hold the picture frame against the wall and above the hanger, and then slide the picture frame downward against the wall in an effort to approach the hanger from the top of the hanger. Unfortunately, the lateral projectile in the anchor section becomes an obstacle that blocks the entrance to U-hook in the hook section of the hanger. As a result, it requires a person to take time and effort to engage the hanging wire into the U-hook of the hanger. Frequently, the hanging wire can be mistakenly hung onto the top of lateral projectile of the anchor section rather than the U-hook of the hook section. The picture frame is therefore unstably hung onto the hanger, and can easily slip out of the hanger.

Therefore, there is a need to provide a picture frame hanger capable of being fabricated from continuously bending of a metal strip, capable of being attached to wall by driving a nail through the hanger and into the wall in inclined position, and capable of engaging the hanging wire of the picture frame into the hook section of the hanger without interference from the anchor section of the hanger.

SUMMARY OF THE INVENTION

An object of the invention is to provide a hanger having an anchor section in the lower part of the hanger for driving a nail through the hanger and into the wall in inclined position, and having a hook section in the upper part of the hanger for suspending and retaining the picture frame hanging wire.

Another object of the invention is to provide such a hanger, in which the hanging wire of the picture frame directly engages into the hook section of the hanger without interference while sliding the picture frame downward against the wall and approaching the hanger from the top of hanger.

Another object of the invention is to provide such a hanger capable of being fabricated by continuously bending of a metal strip.

Another object of the invention is to provide such a hanger that does not pivot or swivel about the anchoring nail.

DESCRIPTION OF THE PREFERRED EMBODIMENTS

Figure 1:
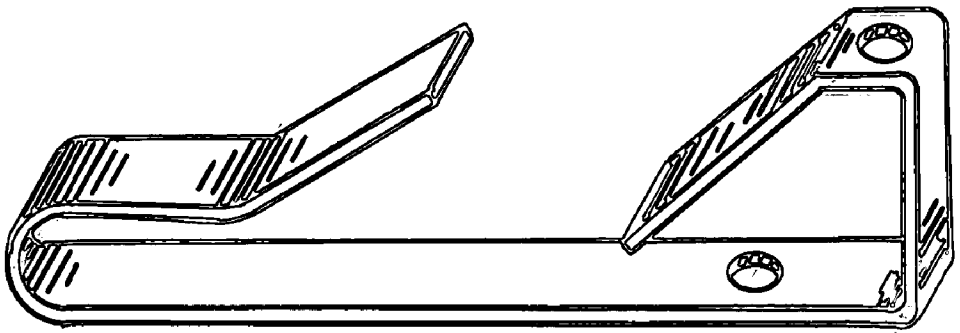
PRIOR ART FIG. 1
FIG. 1 is a perspective view of a picture frame hanger of prior art.

FIG. 1 shows a picture frame hanger of prior art. The hanger has a lateral projectile at the top of hanger that forms an anchor section of the hanger. The lateral projectile guides nail driving through the anchor section of the hanger and into the wall in inclined position. Such lateral projectile blocks the entrance to the U-hook below when the hanging wire of a picture frame approaches the hanger from the top of hanger.

Figure 2A:
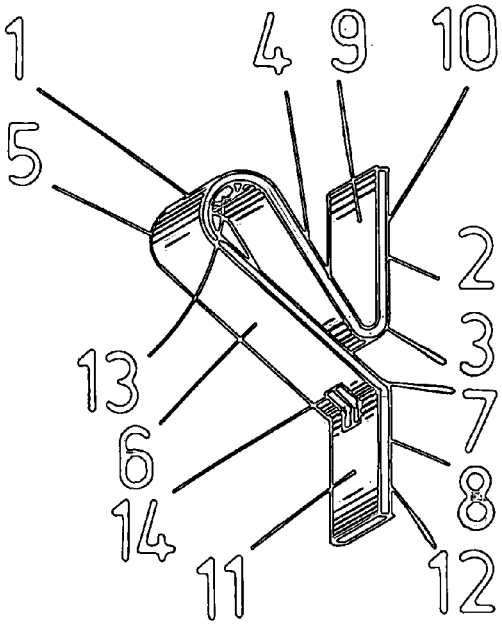
FIG. 2A is a perspective view of the first preferred embodiments of the invention.
Figure 2B:
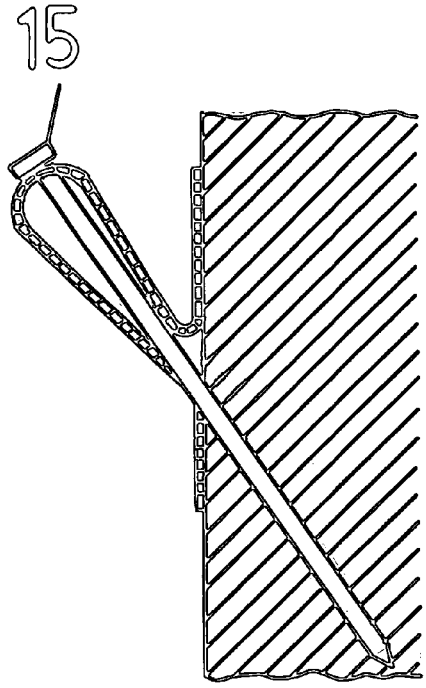
FIG. 2B is a sectional view of the first preferred embodiments of the invention.

FIG. 2A and FIG. 2B show the first preferred embodiments of the picture frame hanger of the invention. The hanger 1 of the invention comprises of a first vertical leg 2, a first bend 3, a second inclined leg 4, a second bend 5, a third inclined leg 6, a third bend 7 and a fourth vertical leg 8. The first vertical leg 2 has a frontward vertical surface 9 and a rearward vertical surface 10. The fourth vertical leg 8 has a frontward vertical surface 11 and a rearward vertical surface 12. Both rearward surfaces 10 and 12 are flushed to the vertical surface of a wall when hanger 1 is attached to the wall The first bend 3 is about a ¾ circular, frontward and upward bend that connects the lower end of first leg 2 and the lower end of second leg 4 in inclined position. The first leg 2, first bend 3 and second leg 4 form an U-hook that becomes a hook section of the hanger 1.

The second bend 5 is about a ½ circular, downward and rearward bend that connects the upper end of second leg 4 and the upper end of the third leg 6 in inclined position. The third bend 7 is a metric bend that connects the lower end of third leg 6 and the upper end of the fourth leg 8 in vertical position. A first and second through holes 13 and 14 are provided in the bending areas of second and third bends 5 and 7 respectively. The first hole 13 is about a circular hole with a diameter slightly greater than a nail 15. The second hole 14 is a slot hole extending in the longitudinal direction from the lower end of third leg 6 to the upper end of fourth leg 8. The nail 15 penetrates hanger 1 though first and second holes 13 and 14, and enters into the wall in inclined position. The second bend 5, third leg 6, third bend 7 and fourth leg 8 form an anchor section of hanger 1 that anchors nail 15 into the wall. Alternatively, redundant first and second through holes 13 and 14 can be provided in the bending areas of second and third bends 5 and 7 respectively. (Not shown in FIG. 2A and FIG. 2B) This allows redundant nail to drive through hanger 1 in parallel to nail 15 so that the loading capacity of hanger 1 can be increased.

As shown in FIG. 2A and FIG. 2B, there is a small gap between the lower end of second leg 4 and the lower end of third leg 6. This gap is smaller than the diameter of nail 15 so that nail 15 can only penetrate the gap area through the second hole 14. Alternatively, such a gap can be eliminated to allow the lower end of second leg 4 in the area of first bend 3 making contact with the lower end of third leg 6 in the area of third bend 7.

According to the first preferred embodiments of present invention, the anchor section of hanger 1 including nail 15 is positioned below the hook section of hanger 1. This allows a hanging wire to immediately engage into the hook section of hanger 1 without interference when the hanging wire approaches to hanger 1 from the top of hanger 1. Preferably, the nail 15 drives through hanger 1 and into the wall at an angle between 45 degree and 60 degree departing from a horizontal plan. This not only maximizes the loading capacity of hanger 1, but also prevents hanger 1 from swiveling or pivoting, and prevents nail 15 from slipping out of the wall. The hook and anchor sections of hanger 1 are integrated in such way that hanger 1 can be fabricated from continuously bending of a metal strip.

Figure 3A:
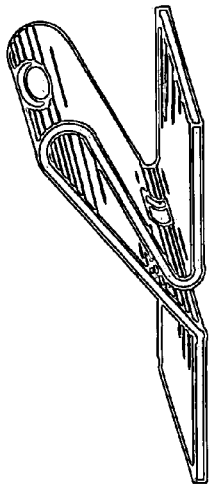
FIG. 3A is a perspective view of the alternative form of the first preferred embodiments of the invention.
Figure 3B:
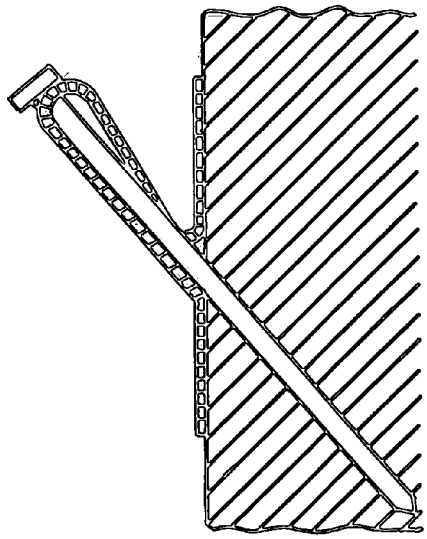
FIG. 3B is a sectional view of the alternative form of the first preferred embodiments of the invention.

FIG. 3A and FIG. 3B show an alternative form of FIG. 2A and FIG. 2B respectively. Such an alternative form incorporates a change that relocates the second hole 14 from the area of third bend 7 to the area of first bend 3.

Figure 4A:
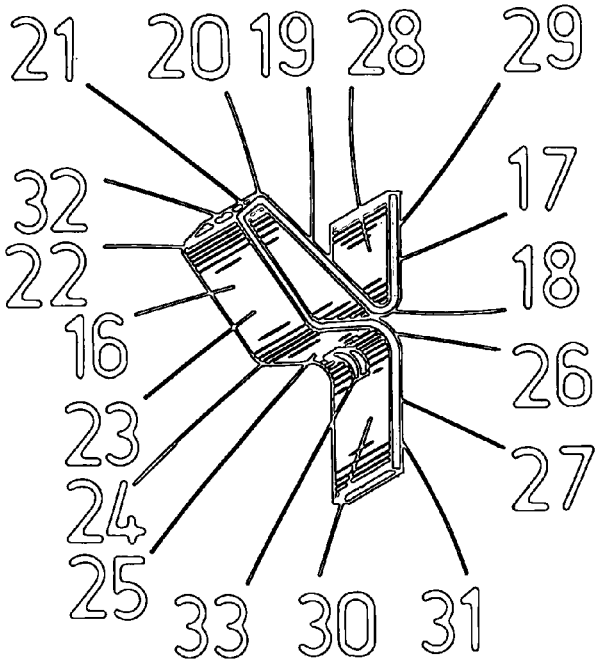
FIG. 4A is a perspective view of the second preferred embodiments of the invention.
Figure 4B:
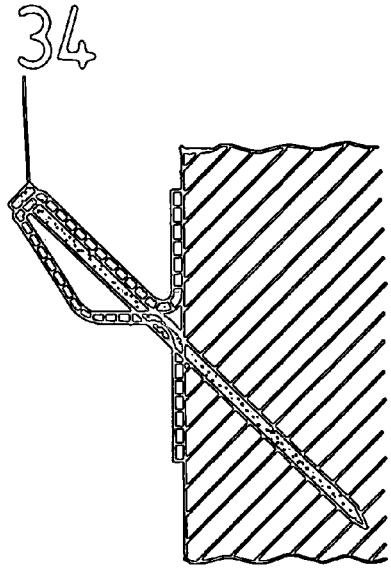
FIG. 4B is a sectional view of the second preferred embodiments of the invention.

FIG. 4A and FIG. 4B show the second preferred embodiments of the picture frame hanger of the invention. The hanger 16 comprises of a first vertical leg 17, a first bend 18, a second inclined leg 19, a second bend 20, a third leg 21, a third bend 22, a fourth leg 23, a fourth bend 24, a fifth leg 25, a fifth bend 26 and a sixth vertical leg 27. The first vertical leg 17 has a frontward vertical surface 28 and a rearward vertical surface 29. The sixth vertical leg 27 has a frontward vertical surface 30 and a rearward vertical surface 31. The rearward vertical surfaces 29 and 31 are flushed to the vertical surface of the wall when hanger 16 is attached to the wall.

The first bend 18 is about a ¾ circular, frontward and upward bend that connects the lower end of first leg 17 and the lower end of second leg 19 in inclined position. The first leg 17, first bend 18 and second leg 19 form an U-hook that becomes a hook section of the hanger 16.

The second bend 20 is about a 90 degree metric and frontward bend that connects the upper end of second leg 19 and the rearward end of the third leg 21. The third bend 22 is about a 90 degree metric and downward bend that connects the frontward end of third leg 21 and the upper end of the fourth leg 23 in inclined position. The fourth bend 24 is an upward bend that connects the lower end of fourth leg 23 and the frontward end of the fifth leg 25. The fifth bend 26 is a downward bend that connects the rearward end of fifth leg 25 and the upper end of sixth leg 27 in vertical position.

A first circular hole 32 is provided in mid section of third leg 21. A second slot hole 33 is provided in the area of fifth bend 26 that extends in the longitudinal direction from the rearward end of fifth leg 25 and the upper end of sixth leg 27. A nail 34 drives through first and second holes 32 and 33 before entering into the wall. The third, fourth, fifth and sixth legs and bends 21 through 27 form an anchor section of the hanger 16. Alternatively, redundant first and second through holes 32 and 33 can be provided in the third leg 21 and the bending area of fifth bend 26 respectively. (Not shown in FIG. 4A and FIG. 4B) This allows redundant nail to drive through hanger 16 in parallel to nail 34 so that the loading capacity of hanger 16 can be increased.

As shown in FIG. 4A and FIG. 4B, the lower end of second leg 19 makes contact with the rearward end of fifth leg 25 in the areas of first and fifth bends 18 and 26. Alternatively, the lower end of second leg 19 does not make contact with the rearward end of fifth leg 25 in the areas of first and fifth bends 18 and 26. This provides a small gap between the lower end of second leg 19 and the rearward end of fifth leg 25 in the areas of first and fifth bends 18 and 26. Such a gap must be smaller than the diameter of nail 34 so that nail 34 can only penetrate the gap area through the second hole 33.

According to the second preferred embodiments of present invention, the anchor section of hanger 16 including nail 34 is positioned below the hook section of hanger 16. This allows a hanging wire to immediately engage into the hook section of hanger 16 without interference when the hanging wire approaches to hanger 16 from the top of hanger 16. Preferably, the nail 34 drives through hanger 16 and into the wall at an angle between 45 degree and 60 degree departing from a horizontal plan. This not only mazes the loading capacity of hanger 16, but also prevents hanger 16 from swiveling or pivoting, and prevents nail 34 from slipping out of the wall The hook and anchor sections of hanger 16 are integrated in such way that hanger 16 can be fabricated from continuously bending of a metal strip.

Figure 5A:
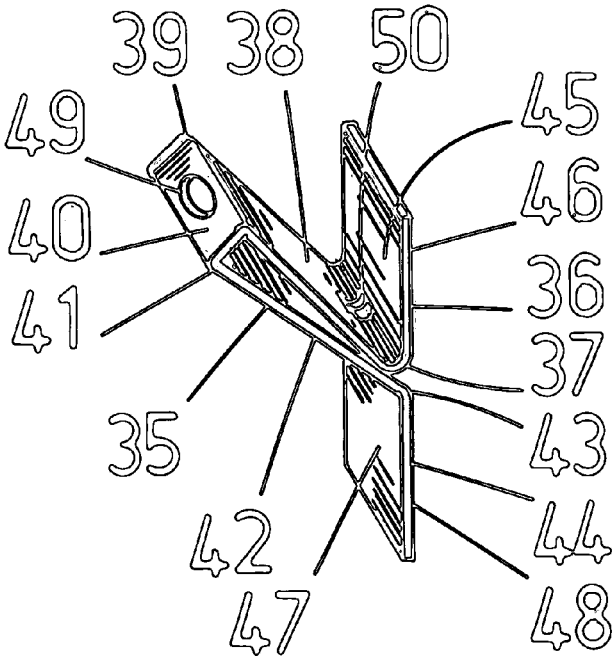
FIG. 5A is a perspective view of the third preferred embodiments of the invention.
Figure 5B:
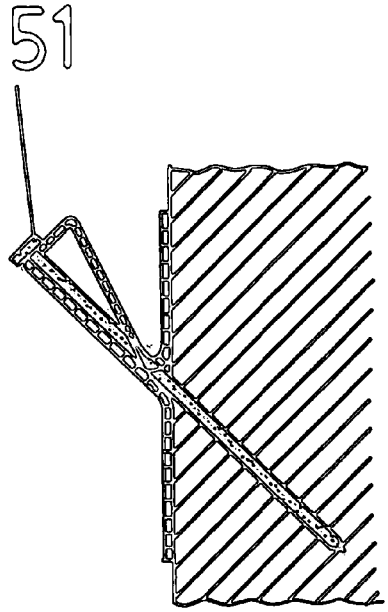
FIG. 5B is a sectional view of the third preferred embodiments of the invention.

FIG. 5A and FIG. 5B show the third preferred embodiments of the picture frame hanger of the invention. The hanger 35 comprises of a first vertical leg 36, a first bend 37, a second inclined leg 38, a second bend 39, a third leg 40, a third bend 41, a fourth leg 42, a fourth bend 43 and a fifth vertical leg 44. The first vertical leg 36 has a frontward vertical surface 45 and a rearward vertical surface 46. The fifth vertical leg 44 has a frontward vertical surface 47 and a rearward vertical surface 48. The rearward vertical surfaces 46 and 48 are flushed to the vertical surface of the wall when hanger 35 is attached to the wall.

The first bend 37 is about a ¾ circular, frontward and upward bend that connects the lower end of first leg 36 and the lower end of second leg 38 in inclined position. The first leg 36, first bend 37 and second leg 38 form an U-hook that becomes a hook section of the hanger 35.

The second bend 39 is about a 90 degree metric and frontward bend that connects the upper end of second leg 38 and the rearward end of the third leg 40. The third bend 41 is about a 90 degree metric and downward bend that connects the frontward end of third leg 40 and the upper end of the fourth leg 42 in inclined position. The fourth bend 43 is a downward bend that connects the lower end of fourth leg 42 and the upper end of the fifth leg 44.

A first circular hole 49 is provided in mid section of third leg 40. A second slot hole 50 is provided in the area of first bend 37 that extends in the longitudinal direction from the lower end of second leg 38 to the lower end of first leg 36. A nail 51 drives through first and second holes 49 and 50 before entering into the wall The second, third, fourth, and fifth legs and bends 39 through 44 form an anchor section of the hanger 35. Alternatively, redundant first and second through holes 49 and 50 can be provided in the third leg 40 and the bending area of first bend 37 respectively. (Not shown in FIG. 5A and FIG. 5B) This allows redundant nail to drive through hanger 35 in parallel to nail 51 so that the loading capacity of hanger 35 can be increased.

As shown in FIG. 5A and FIG. 5B, the lower end of second leg 38 makes contact with the lower end of fourth leg 42 in the areas of first and fourth bends 37 and 43. Alternatively, the lower end of second leg 38 does not make contact with the lower end of fourth leg 42 in the areas of first and fourth bends 37 and 43. This provides a small gap between the lower end of second leg 38 and the lower end of fourth leg 42 in the areas of first and fourth bends 37 and 43. Such a gap must be smaller than the diameter of nail 51 so that nail 51 can only penetrate the gap area through the second hole 50.

According to the third preferred embodiments of present invention, the anchor section of hanger 35 including nail 51 is positioned below the hook section of hanger 35. This allows a hanging wire to immediately engage into the hook section of hanger 35 without interference when the hanging wire approaches to hanger 35 from the top of hanger 35. Preferably, the nail 51 drives through hanger 35 and into the wall at an angle between 45 degree and 60 degree departing from a horizontal plan. This not only mazes the loading capacity of hanger 35, but also prevents hanger 35 from swiveling or pivoting, and prevents nail 51 from slipping out of the wall. The hook and anchor sections of hanger 35 are integrated in such way that hanger 35 can be fabricated from continuously bending of a metal strip.

Figure 6A:
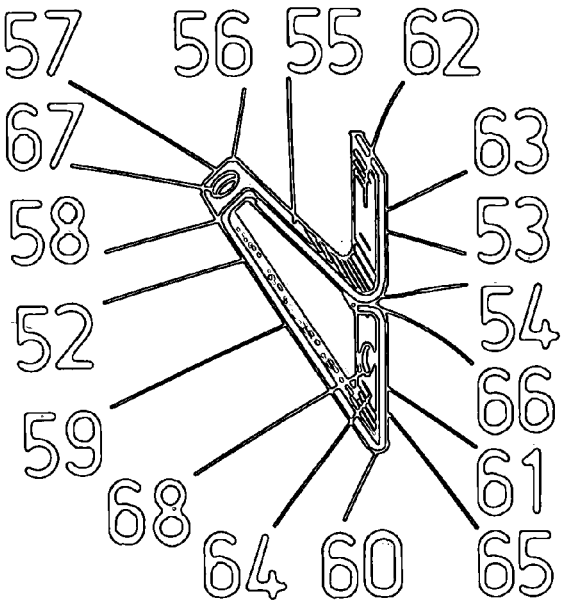
FIG. 6A is a perspective view of the fourth preferred embodiments of the invention.
Figure 6B:
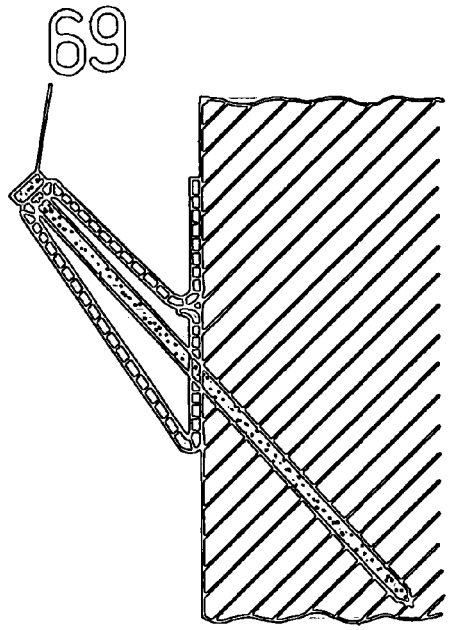
FIG. 6B is a sectional view of the fourth preferred embodiments of the invention.

FIG. 6A and FIG. 6B show the fourth preferred embodiments of the picture frame hanger of the invention. The hanger 52 comprises of a first vertical leg 53, a first bend 54, a second inclined leg 55, a second bend 56, a third leg 57, a third bend 58, a fourth leg 59, a fourth bend 60 and a fifth vertical leg 61. The first vertical leg 53 has a frontward vertical surface 62 and a rearward vertical surface 63. The fifth vertical leg 61 has a frontward vertical surface 64 and a rearward vertical surface 65. The rearward vertical surfaces 63 and 65 are flushed to the vertical surface of the wall when hanger 52 is attached to the wall.

The first bend 54 is about ¾ circular, frontward and upward bend that connects the lower end of first leg 53 and the lower end of second leg 55 in inclined position. The first leg 53, first bend 54 and second leg 55 form an U-hook that becomes a hook section of the hanger 52.

The second bend 56 is about a 90 degree metric and downward bend that connects the upper end of second leg 55 and the rearward end of the third leg 57. The third bend 58 is about a 90 degree metric and downward bend that connects the frontward end of third leg 57 and the upper end of the fourth leg 59 in inclined position. The fourth bend 60 is an upward bend that connects the lower end of fourth leg 59 and the lower end of the fifth leg 61. The upper end of fifth leg 61 is provided with a projectile 66 in frontward direction that makes contact with the bottom of the first bend 54.

A first circular hole 67 is provided in mid section of third leg 57. A second circular hole 68 is provided in mid section of fifth leg 61. A nail 69 drives through first and second holes 67 and 68 before entering into the wall. The second, third, fourth and fifth legs and bends 56 through 61 form an anchor section of the hanger 52. Alternatively, redundant first and second through holes 67 and 68 can be provided in the third leg 57 and the fifth leg 61 respectively. (Not shown in FIG. 6A and FIG. 6B) This allows redundant nail to drive through hanger 52 in parallel to nail 69 so that the loading capacity of hanger 52 can be increased.

According to the fourth preferred embodiments of present invention, the anchor section of hanger 52 including nail 69 is positioned below the hook section of hanger 52. This allows a hanging wire to immediately engage into the hook section of hanger 52 without interference when the hanging wire approaches to hanger 52 from the top of hanger 52. Preferably, the nail 69 drives through hanger 52 and into the wall at an angle between 45 degree and 60 degree departing from a horizontal plan. This not only maximizes the loading capacity of hanger 52, but also prevents hanger 52 from swiveling or pivoting, and prevents nail 69 from slipping out of the wall. The hook and anchor sections of hanger 52 are integrated in such way that hanger 52 can be fabricated from continuously bending of a metal strip.

Figure 7A:
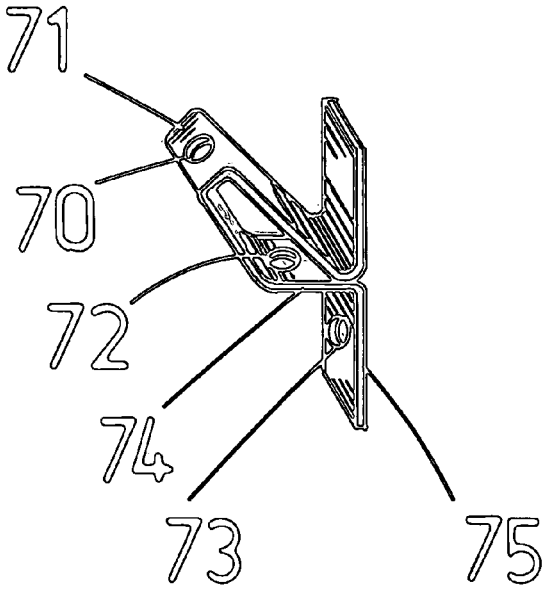
FIG. 7A is a perspective view of the fifth preferred embodiments of the invention.
Figure 7B:
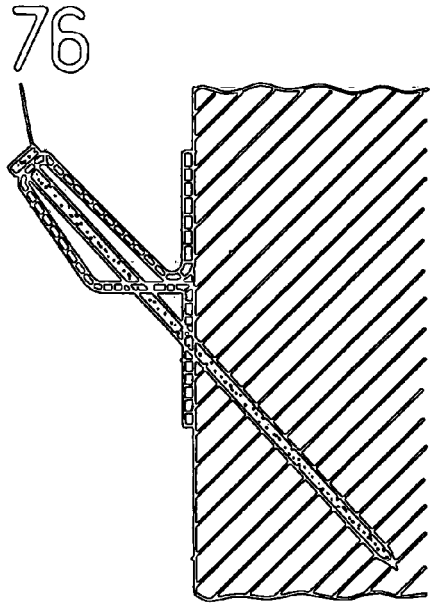
FIG. 7B is a sectional view of the fifth preferred embodiments of the invention.

FIG. 7A and FIG. 7B show the fifth preferred embodiments of the picture frame hanger of the invention. The fifth preferred embodiments are the alternative form of the second preferred embodiments shown in FIG. 4A and FIG. 4B. The fifth preferred embodiments are identical to the second preferred embodiments with one exception. In FIG. 4A and FIG. 4B, the first circular hole 32 is provided in mid section of the third leg 21, and the second slot hole 33 is provided in the area of fifth bend 26. However, in FIG. 7A and FIG. 7B, the first circular hole 70 is provided in mid section of third leg 71, the second and third circular holes 72 and 73 are provided in mid section of fifth and sixth legs 74 and 75 respectively. Nail 76 drives through first, second and third circular holes 70, 72 and 73 before entering into the wall.

Figure 8A:
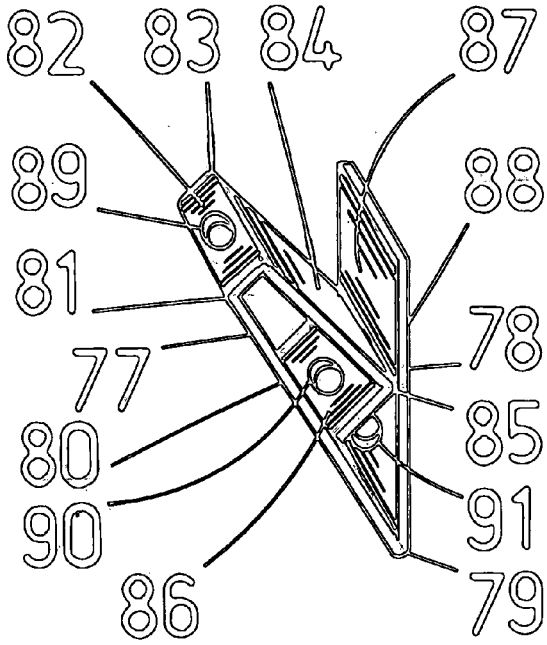
FIG. 8A is a perspective view of the sixth preferred embodiments of the invention.
Figure 8B:
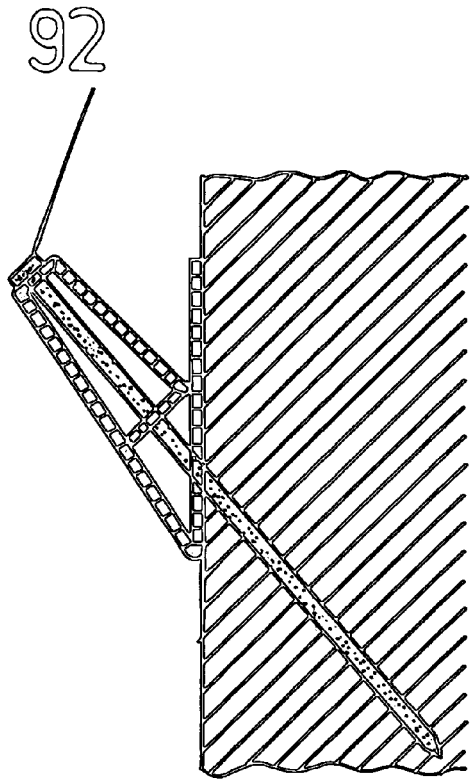
FIG. 8B is a sectional view of the sixth preferred embodiments of the invention.

FIG. 8A and FIG. 8B show the sixth preferred embodiments of the picture frame hanger of the invention. The hanger 77 comprises of a first vertical leg 78, a first bend 79, a second inclined leg 80, a second bend 81, a third leg 82, a third bend 83, a fourth leg 84, a fourth bend 85 and a fifth leg 86. The first vertical leg 78 has a frontward vertical surface 87 and a rearward vertical surface 88. The rearward vertical surface 88 is flushed to the vertical surface of the wall when hanger 77 is attached to the wall The first bend 79 is a frontward and upward bend that connects the lower end of first leg 78 and the lower end of second leg 80 in inclined position. The second bend 81 is about a 90 degree rearward bend that connects the upper end of second leg 80 and the frontward end of the third leg 82. The third bend 83 is about a 90 degree downward bend that connects the rearward end of third leg 82 and the upper end of the fourth leg 84. The fourth bend 85 is about a 90 degree downward bend that connects lower end of fourth leg 84 and the upper end of the fifth leg 86. The fourth bend 85 makes contact with the frontward vertical surface 87 of first leg 78 in mid section of first leg 78. The fourth bend 85 also positions fifth leg 86 in perpendicular to second leg 80. The lower end of the fifth leg 86 makes contact with second leg 80. This arrangement keeps fourth bend 85 in close contact with the frontward vertical surface 87 of the first leg 78 when the fourth bend 85 is subject to weight. This is necessary because the upper part of first leg 78, fourth bend 85 and fourth leg 84 form an U-hook, and become the hook section of hanger 77.

A first, second and third circular holes 89, 90 and 91 are provided in mid sections of third, fifth and first legs 82, 86 and 78 respectively. A nail 92 drives through first, second and third holes 89, 90 and 91 before entering into the wall. Alternatively, redundant first, second and third through holes 89, 90 and 91 can be provided in the third, fifth and first legs 82, 86 and 78 respectively. (Not shown in FIG. 8A and FIG. 8B) This allows redundant nail to drive through hanger 77 in parallel to nail 92 so that the loading capacity of hanger 77 can be increased.

According to the sixth preferred embodiments of present invention, the anchor section of hanger 77 including nail 92 is positioned below the hook section of hanger 77. This allows a hanging wire to immediately engage into the hook section of hanger 77 without interference when the hanging wire approaches to hanger 77 from the top of hanger 77. Preferably, the nail 92 drives through hanger 77 and into the wall at an angle between 45 degree and 60 degree departing from a horizontal plan This not only maximizes the loading capacity of hanger 77, but also prevents hanger 77 from swiveling or pivoting, and prevents nail 92 from slipping out of the wall. The hook and anchor sections of hanger 77 are integrated in such way that hanger 77 can be fabricated from continuously bending of a metal strip.

Figure 9A:
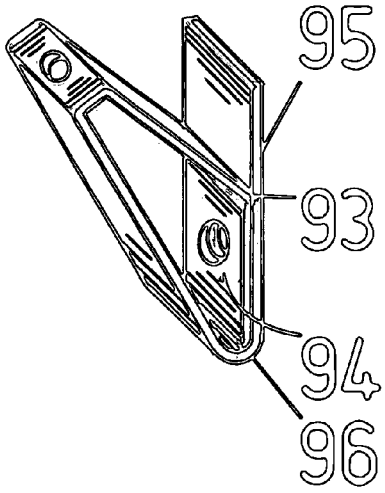
FIG. 9A is a perspective view of the seventh preferred embodiments of the invention.
Figure 9B:
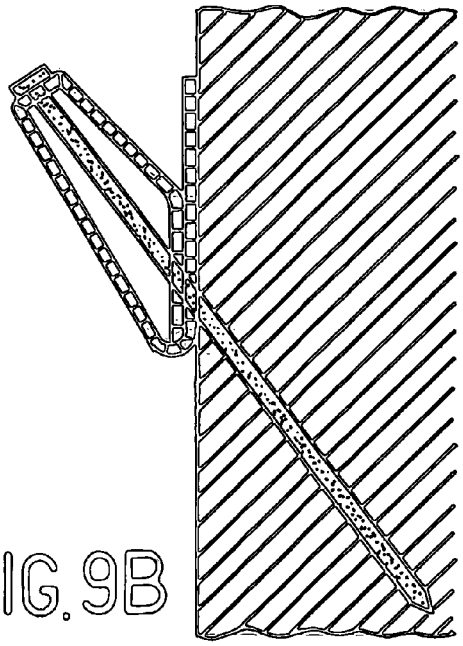
FIG. 9B is a sectional view of the seventh preferred embodiments of the invention.

FIG. 9A and FIG. 9B show the seventh preferred embodiments of the picture frame hanger of the invention. The seventh preferred embodiments are the alternative form of the sixth preferred embodiments shown in FIG. 8A and FIG. 8B. The seventh preferred embodiments are identical to the sixth preferred embodiments with one exception. In FIG. 8A and 8B, the fourth bend 85 is about a 90 degree bend that positions fifth leg 86 in perpendicular to second leg 80. In FIG. 9A and FIG. 9B, the fourth bend 93 is greater than 90 degree that positions the fifth leg 94 in parallel to and in contact with the lower part of first leg 95. The lower end of fifth leg 94 makes contact with first bend 96. This arrangement keeps fourth bend 93 in close contact with first leg 95 when fourth bend 93 is subject to weight.

It is understood that innumerable variations, modifications, applications, and extensions of the principles hereinbefore set forth can be made without departing from the spirit and the scope of the invention.

What is claimed is:

1. A wall-mounted hanger for hanging an object such as a picture frame or a mirror that is provided with a hanging wire attached to the back of said object, in which:

Said hanger comprising of an integral anchor section in a lower part of said hanger for driving a nail through said anchor section and into a wall in an inclined position, and another integral hook section in a upper part of said hanger for engaging and retaining said hanging wire through an opening of said hook section; and Said anchor section and said nail being positioned below the opening of said hook section so that said hanging wire directly engaging into said hook section while moving said object downward against said wall and approaching said hanger from the top of said hanger; and Said anchor and said hook sections being integrated in such way that said hanger being capable of being fabricated from continuously bending of a metal strip.

2. The hanger according to claim 1, in which:

Said hanger comprising of a first vertical leg, a first bend, a second inclined leg, a second bend, a third inclined leg, a third bend and a fourth vertical leg; and Said first vertical leg having a first rearward and frontward vertical surfaces, said fourth vertical leg having a second rearward and frontward vertical surfaces, and said first and second rearward surfaces being flushed to a vertical surface of said wall while said hanger being attached to said wall; and Said first bend being an upward and frontward bend connecting the lower end of said first leg and the lower end of said second leg in inclined position; and Said first leg, said first bend and said second leg forming said hook section of said hanger; and Said second bend being a downward and rearward bend connecting the upper end of said second leg and the upper end of said third leg in inclined position; and Said third bend being a downward bend connecting the lower end of said third leg and the upper end of said fourth leg in vertical position; and A first through hole in the form of a circular hole being provided in the area of said second bend, and a second through hole in the form a slot hole being provided in the area of said third bend that extending in the longitudinal direction from the lower end of said third leg to the upper end of said fourth leg; and Said second bend, said third leg, said third bend and said fourth leg forming said anchor section of said hanger; and Said nail driving through said first hole first, and through said second hole and into said wall in inclined position.

3. The hanger according to claim 2, in which the lower end of said second leg in the area of said first bend makes contact with the lower end of said third leg in the area of said third bend.

4. The hanger according to claim 2, in which the lower end of said second leg in the area of said first bend does not make contact with the lower end of said third leg in the area of said third bend, and there is a gap smaller than the diameter of said nail between the lower end of said second leg and the lower end of said third leg in the areas of said first and third bends.

5. The hanger according to claim 1, in which:

Said hanger comprising of a first vertical leg, a first bend, a second inclined leg, a second bend, a third inclined leg, a third bend and a fourth vertical leg; and Said first vertical leg having a first rearward and frontward vertical surfaces, said fourth vertical leg having a second rearward and frontward vertical surfaces, and said first and second rearward surfaces being flushed to a vertical surface of said wall while said hanger being attached to said wall; and Said first bend being an upward and frontward bend connecting the lower end of said first leg and the lower end of said second leg in inclined position; and Said first leg, said first bend and said second leg forming said hook section of said hanger; and Said second bend being a downward and rearward bend connecting the upper end of said second leg and the upper end of said third leg in inclined position; and Said third bend being a downward bend connecting the lower end of said third leg and the upper end of said fourth leg in vertical position; and A first through hole in the form of a circular hole being provided in the area of said second bend, and a second through hole in the form a slot hole being provided in the area of said first bend that extending in the longitudinal direction from the lower end of said second leg to the lower end of said first leg; and Said second bend, said third leg, said third bend and said fourth leg forming said anchor section of said hanger; and Said nail driving through said first hole first, and through said second hole and into said wall in inclined position.

6. The hanger according to claim 5, in which the lower end of said second leg in the area of said first bend makes contact with the lower end of said third leg in the area of said third bend.

7. The hanger according to claim 5, in which the lower end of said second leg in the area of said first bend does not make contact with the lower end of said third leg in the area of said third bend, and there is a gap smaller than the diameter of said nail between the lower end of said second leg and the lower end of said third leg in the areas of said first and third bends.

8. The hanger according to claim 1, in which:

Said hanger comprising of a first vertical leg, a first bend, a second inclined leg, a second bend, a third leg and bend, a fourth leg and bend, a fifth leg and bend, and a sixth vertical leg; and Said first vertical leg having a first rearward and frontward vertical surfaces, said sixth vertical leg having a second rearward and frontward vertical surfaces, and said first and second rearward surfaces being flushed to a vertical surface of said wall while said hanger being attached to said wall; and Said first bend being an upward and frontward bend connecting the lower end of said first leg and the lower end of said second leg in inclined position; and Said first leg, said first bend and said second leg forming said hook section of said hanger; and Said second bend being a downward bend connecting the upper end of said second leg and the rearward end of said third leg; and Said third bend being a downward and rearward bend connecting the frontward end of said third leg and the upper end of said fourth leg in inclined position; and Said fourth bend being an upward bend connecting the lower end of said fourth leg and the frontward end of said fifth leg; and Said fifth bend being a downward bend connecting the rearward end of said fifth leg and the upper end of said sixth leg in vertical position; and A first through hole in the form of a circular hole being provided in mid section of said third leg, and a second through hole in the form a slot hole being provided in the area of said fifth bend that extending in the longitudinal direction from the rearward end of said fifth leg to the upper end of said sixth leg; and Said second bend, said third leg and bend, said fourth leg and bend, said fifth leg and bend, and said sixth leg forming said anchor section of said hanger; and Said nail driving through said first hole first, and through said second hole and into said wall in inclined position.

9. The hanger according to claim 8 in which the lower end of said second leg in the area of said first bend makes contact with the rearward end of said fifth leg in the area of said fifth bend.

10. The hanger according to claim 8 in which the lower end of said second leg in the area of said first bend does not make contact with the rearward end of said fifth leg in the area of said fifth bend, and there is a gap smaller than the diameter of said nail between the lower end of said second leg and the rearward end of said fifth leg in the areas of said first and fifth bends.

11. The hanger according to claim 1, in which:

Said hanger comprising of a first vertical leg, a first bend, a second inclined leg, a second bend, a third leg and bend, a fourth leg and bend, and a fifth vertical leg; and Said first vertical leg having a first rearward and frontward vertical surfaces, said fifth vertical leg having a second rearward and frontward vertical surfaces, and said first and second rearward surfaces being flushed to a vertical surface of said wall while said hanger being attached to said wall; and Said first bend being an upward and frontward bend connecting the lower end of said first leg and the lower end of said second leg in inclined position; and Said first leg, said first bend and said second leg forming said hook section of said hanger; and Said second bend being a downward bend connecting the upper end of said second leg and the rearward end of said third leg; and Said third bend being a downward and rearward bend connecting the frontward end of said third leg and the upper end of said fourth leg in inclined position; and Said fourth bend being a downward bend connecting the lower end of said fourth leg and the upper end of said fifth leg in vertical position; and A first through hole in the form of a circular hole being provided in mid section of said third leg, and a second through hole in the form a slot hole being provided in the area of said first bend that extending in the longitudinal direction from the lower end of said second leg to the lower end of said first leg; and Said second bend, said third leg and bend, said fourth leg and bend, and said fifth leg forming said anchor section of said hanger; and Said nail driving through said first hole first, and through said second hole and into said wall in inclined position.

12. The hanger according to claim 11 in which the lower end of said second leg in the area of said first bend makes contact with the lower end of said fourth leg in the area of said fourth bend.

13. The hanger according to claim 11 in which the lower end of said second leg in the area of said first bend does not make contact with the lower end of said fourth leg in the area of said fourth bend, and there is a gap smaller than the diameter of said nail between the lower end of said second leg and the lower end of said fourth leg in the areas of said first and fourth bends.

14. The hanger according to claim 1, in which:

Said hanger comprising of a first vertical leg, a first bend, a second inclined leg, a second bend, a third leg and bend, a fourth leg and bend, and a fifth vertical leg; and Said first vertical leg having a first rearward and frontward vertical surfaces, said fifth vertical leg having a second rearward and frontward vertical surfaces, and said first and second rearward surfaces being flushed to a vertical surface of said wall while said hanger being attached to said wall; and Said first bend being an upward and frontward bend connecting the lower end of said first leg and the lower end of said second leg in inclined position; and Said first leg, said first bend and said second leg forming said hook section of said hanger; and Said second bend being a downward bend connecting the upper end of said second leg and the rearward end of said third leg; and Said third bend being a downward and rearward bend connecting the frontward end of said third leg and the upper end of said fourth leg in inclined position; and Said fourth bend being a upward bend connecting the lower end of said fourth leg and the lower end of said fifth leg in vertical position; and The upper end of said fifth leg making contact with the bottom of said first bend; and A first through hole in the form of a circular hole being provided in mid section of said third leg, and a second through hole in the form a circular hole being provided in mid section of said fifth leg; and Said second bend, said third leg and bend, said fourth leg and bend, and said fifth leg forming said anchor section of said hanger; and Said nail driving through said first hole first, and through said second hole and into said wall in inclined position.

15. The hanger according to claim 14 in which a projectile in frontward direction is provided at the upper end of said fifth leg, and said projectile makes contact with the bottom of said first bend.

16. The hanger according to claim 1, in which:

Said hanger comprising of a first vertical leg, a first bend, a second inclined leg, a second bend, a third leg and bend, a fourth leg and bend, a fifth leg and bend, and a sixth vertical leg; and Said first vertical leg having a first rearward and frontward vertical surfaces, said sixth vertical leg having a second rearward and frontward vertical surfaces, and said first and second rearward surfaces being flushed to a vertical surface of said wall while said hanger being attached to said wall; and Said first bend being an upward and frontward bend connecting the lower end of said first leg and the lower end of said second leg in inclined position; and Said first leg, said first bend and said second leg forming said hook section of said hanger; and Said second bend being a downward bend connecting the upper end of said second leg and the rearward end of said third leg; and Said third bend being a downward and rearward bend connecting the frontward end of said third leg and the upper end of said fourth leg in inclined position; and Said fourth bend being an upward bend connecting the lower end of said fourth leg and the frontward end of said fifth leg; and Said fifth bend being a downward bend connecting the rearward end of said fifth leg and the upper end of said sixth leg in vertical position; and A first circular through hole being provided in mid section of said third leg, a second circular through hole being provided in mid section of said fifth leg, and a third circular through hole being provided in mid section of said sixth vertical leg; and Said second bend, said third leg and bend, said fourth leg and bend, said fifth leg and bend, and said sixth leg forming said anchor section of said hanger; and Said nail driving through said first hole first, and through said second and third holes and into said wall in inclined position.

17. The hanger according to claim 16 in which the lower end of said second leg in the area of said first bend makes contact with the rearward end of said fifth leg in the area of said fifth bend.

18. The hanger according to claim 1, in which:

Said hanger comprising of a first vertical leg, a first bend, a second inclined leg, a second bend, a third leg and bend, a fourth leg and bend, and a fifth leg; and Said first vertical leg having a first rearward and frontward vertical surfaces, and said first rearward surface being flushed to a vertical surface of said wall while said hanger being attached to said wall; and Said first bend being an upward and frontward bend connecting the lower end of said first leg and the lower end of said second leg in inclined position; and Said second bend being a rearward bend connecting the upper end of said second leg and the frontward end of said third leg; and Said third bend being a downward bend connecting the rearward end of said third leg and the upper end of said fourth leg in inclined position; and Said fourth bend being a downward and frontward bend connecting the lower end of said fourth leg and the upper end of said fifth leg in perpendicular to said second leg, said fourth bend making contact with said frontward surface of said first leg in mid section of said first leg, and the lower end of said fifth leg making contact with said second leg; and A first circular through hole being provided in mid section of said third leg, a second circular through hole being provided in mid section of said fifth leg, and a third circular through hole being provided in the lower part of said first leg; and Said fourth leg, said fourth bend and the upper part of said first leg forming said hook section of said hanger; and The lower part of said first leg, said first bend, said second leg and bend, said third leg and bend, said fourth leg and bend, and said fifth leg forming said anchor section of said hanger; and Said nail driving through said first hole first, and through said second and third holes and into said wall in inclined position.

19. The hanger according to claim 1, in which:

Said hanger comprising of a first vertical leg, a first bend, a second inclined leg, a second bend, a third leg and bend, a fourth leg and bend, and a fifth vertical leg; and Said first vertical leg having a first rearward and frontward vertical surfaces, and said first rearward surface being flushed to a vertical surface of said wall while said hanger being attached to said wall; and Said first bend being an upward and frontward bend connecting the lower end of said first leg and the lower end of said second leg in inclined position; and Said second bend being a rearward bend connecting the upper end of said second leg and the frontward end of said third leg; and Said third bend being a downward bend connecting the rearward end of said third leg and the upper end of said fourth leg in inclined position; and Said fourth bend being a downward bend connecting the lower end of said fourth leg and the upper end of said fifth leg in vertical position, and said fourth bend making contact with said frontward surface of said first leg in mid section of said first leg; and Said fifth vertical having a frontward and rearward vertical surfaces, said rearward vertical surface of said fifth leg being flushed to said frontward surface of said first leg, and the lower end of said fifth leg making contact with said first bend; and A first circular through hole being provided in mid section of said third leg, a second circular through hole being provided in mid section of said fifth leg, and a third circular through hole being provided in the lower part of said first leg; and Said fourth leg, said fourth bend and the upper part of said first leg forming said hook section of said hanger; and The lower part of said first leg, said first bend, said second leg and bend, said third leg and bend, said fourth leg and bend, and said fifth leg forming said anchor section of said hanger; and Said nail driving through said first hole first, and through said second and third holes and into said wall in inclined position.

* * * * *